US010293390B2

(12) United States Patent
Shen et al.

(10) Patent No.: US 10,293,390 B2
(45) Date of Patent: May 21, 2019

(54) ROLLING MILL LAYING HEAD

(71) Applicant: Siemens Industry, Inc., Alpharetta, GA (US)

(72) Inventors: William Shen, Boylston, MA (US); Peiliang P. Zhang, Shrewsbury, MA (US); Jianping Zhang, Newton, MA (US)

(73) Assignee: Primetals Technologies USA LLC, Alpharetta, GA (US)

( * ) Notice: Subject to any disclaimer, the term of this patent is extended or adjusted under 35 U.S.C. 154(b) by 855 days.

(21) Appl. No.: 14/645,779

(22) Filed: Mar. 12, 2015

(65) Prior Publication Data

US 2015/0202673 A1 Jul. 23, 2015

Related U.S. Application Data

(63) Continuation of application No. PCT/US2013/057993, filed on Sep. 4, 2013, and a (Continued)

(51) Int. Cl.

| | |
|---|---|
| ***B21C 47/14*** | (2006.01) |
| ***B65H 57/12*** | (2006.01) |
| ***B65H 57/26*** | (2006.01) |

(52) U.S. Cl.

CPC ..... *B21C 47/14* (2013.01); *B21C 47/143* (2013.01); *B65H 57/12* (2013.01); *B65H 57/26* (2013.01); *B21C 47/146* (2013.01)

(58) Field of Classification Search

CPC ..... B21C 47/14; B21C 47/143; B21C 47/146; B65H 57/12; B65H 57/26; B21D 11/00; B21D 11/06

(Continued)

(56) References Cited

U.S. PATENT DOCUMENTS 4,242,892 A * 1/1981 Wykes ..... B21C 47/143 140/2

5,312,065 A 5/1994 Shore et al.

(Continued)

FOREIGN PATENT DOCUMENTS

CN 1081125 A 1/1994
CN 1281352 C 10/2006

(Continued)

OTHER PUBLICATIONS

International Search Report issued in PCT/US2013/057993 dated Mar. 20, 2014.

(Continued)

*Primary Examiner* — Edward T Tolan
*Assistant Examiner* — Gregory D Swiatocha
(74) *Attorney, Agent, or Firm* — Gesmer Updegrove LLP

(57) ABSTRACT

A laying head for forming an axially moving hot rolled product into a helical series of rings includes a quill rotatable about an axis, with a tubular body journaled for rotation between axially spaced bearings, and a nose projecting axially and forwardly from its tubular body. A product guide is carried by the quill. The product guide is configured to form the product into a helical series of rings. A guide trough provides a helical extension of the product guide. Major portions of the product guide and the guide trough are carried on a continuous helical support on the nose of the quill. The guide trough is channel shaped, with a continuous bottom defining the rim of the helical support, and with segmented detachable side walls.

23 Claims, 8 Drawing Sheets

Related U.S. Application Data continuation of application No. 13/614,145, filed on Sep. 13, 2012, now abandoned.

(60) Provisional application No. 61/707,510, filed on Sep. 28, 2012.

(58) Field of Classification Search
USPC ..... 72/66, 135, 141, 142, 371; 242/361, 242/361.2
See application file for complete search history.

(56) References Cited

U.S. PATENT DOCUMENTS

| | | | | |
|---|---|---|---|---|
| 6,179,237 | B1 | 1/2001 | David et al. | |
| 6,195,486 | B1 * | 2/2001 | Field | G02B 6/4433 385/100 |
| 6,769,641 | B2 * | 8/2004 | Pariseau | B21C 47/143 242/361 |
| 8,024,949 | B2 * | 9/2011 | Shore | B21C 47/143 72/134 |
| 2003/0122017 | A1 | 7/2003 | Pariseau et al. | |
| 2005/0001086 | A1 | 1/2005 | Shore et al. | |
| 2009/0001208 | A1 * | 1/2009 | Haak | B21C 47/143 242/361.3 |

FOREIGN PATENT DOCUMENTS

| | | | |
|---|---|---|---|
| DE | 60302390 | T2 | 7/2006 |
| EP | 0554976 | A1 | 8/1993 |
| JP | S62137609 | U | 8/1987 |
| JP | H08215751 | | 8/1996 |
| JP | 2000026023 | A | 1/2000 |
| JP | 2005511317 | A | 4/2005 |
| RU | 2097157 | C1 | 11/1997 |
| RU | 2272689 | C1 | 3/2006 |
| SU | 1611492 | A1 | 12/1990 |
| TW | 209184 | | 7/1993 |
| TW | 200300711 | | 6/2003 |
| TW | 200401679 | | 2/2004 |
| WO | 03/051553 | | 6/2003 |

OTHER PUBLICATIONS

International Report on Patentability issued in PCT/US2013/057993 dated Mar. 17, 2015.

Written Opinion of the International Searching Authority issued in PCT/US2013/057993 dated Mar. 13, 2015.

Office Action issued by the Japanese Patent Office dated Jul. 10, 2017 in related Japanese Patent Application No. 2015-531954.

Notice of Allowance issued by the Russian Patent Office dated Jul. 6, 2017 in related Application No. 2015113438/02 (021046).

Chinese Office Action issued in connection with corresponding CN Application No. 2013800584918, dated Jan. 5, 2016 and English translation thereof.

Seki, Ryuichi, "Making to High Performance and Productivity Improvement of Steel Bar and Wire Rod Rolling Process" Nippon Steel Technical Report No. 96, Jul. 2007, pp. 21-28.

Search Report issued by the Taiwanese Patent Office dated Oct. 21, 2016 in Taiwanese Application No. 102132717.

* cited by examiner

ROLLING MILL LAYING HEAD

PRIORITY INFORMATION

This application is a continuation of PCT Application No. PCT/US2013/057993 filed Sep. 4, 2013, which claims the benefit, under 35 U.S.C. § 119(e), of U.S. Provisional Application Ser. No. 61/707,510 filed on Sep. 28, 2012, and U.S. Utility Application Ser. No. 13/614,145 filed Sep. 13, 2012, the contents and substance of which are herein incorporated by reference.

BACKGROUND

1. Field

Aspects of the present invention relate to high speed rod rolling mills, and more particularly to improvements to the laying heads employed in such mills to form the hot rolled product into a helical series of rings.

2. Description of Related Art

With reference to FIG. 1, a conventional laying head 10 includes a housing containing a rotatably driven hollow quill 12. The quill is subdivided into a tubular body 12*a* journalled for rotation between axially spaced bearings 14, 16, and a nose 18 detachably secured by means of a mounting flange 20 to the tubular body 12*a*. The nose projects axially and forwardly in cantilever fashion from the tubular body.

The quill 12 carries a product guide, typically in the form of a three dimensionally curved laying pipe 22. The laying pipe has an entry end 22*a* aligned with the rotational axis "X" of the quill 12, and a curved intermediate section 12*b* leading to a delivery end 22*c* spaced radially from axis X.

Hot rolled steel rod is directed into the entry end 22*a* of the laying pipe 22 along axis X, and exits from the delivery end 22*c* as a helical formation of rings (not shown). Upon exiting from the delivery end 22*c* of the laying pipe 22, the rings are additionally confined and moved forward by a helical guide trough 24 surrounded by a cylindrical shroud 26. The guide trough 24 is configured and dimensioned to coact with the shroud 26 in providing an axially and radially confined helical extension of the guide path defined by the laying pipe 22.

Although this extended confinement has proven to be highly beneficial in resisting distortion and kinking of the tail ends of products as they exit from the laying head 10, the manner of supporting the guide trough 24, as well as its design, have given rise to difficulties that have been found to compromise high speed operation of the laying head.

For example, the curved intermediate portion 12*b* of the laying pipe 22 is supported on the nose 18 by radially projecting struts 28, whereas the guide trough 24 is carried on a separate disc-shaped trough support 30 detachably mounted on the end of the cantilevered nose 18.

With further reference to FIGS. 2 and 3, the disc-shaped trough support 30 may be seen as including a hub 32 at the center of a helical plate 34 on the outer rim of which are attached channel-shaped trough segments typically indicated at 24'.

The helical plate 34 is typically welded to the hub 32, with the resulting structure of the trough support 30 being robust and consequently heavy in order to withstand the stresses resulting from high speed operation of the laying head. Moreover, difficulties are encountered in accurately aligning the trough support 30 with the rotational axis X of the laying head, with even slight misalignments causing disruptive vibrations at high speeds.

An additional drawback relates to the conventional trough segments 24', which typically comprise unitary expensive investment castings. The traditional casting materials have been found to lack adequate resistance to wear occasioned by frictional contact with the hot rolled product. Attempts at dealing with this problem have included increasing the thicknesses of the trough segment side walls, but the resulting increased weight has been found to further contribute to instability of the laying head.

SUMMARY

Broadly stated, aspects of the present invention include supporting both the product guide, which may comprise a laying pipe, and the guide trough, on a continuous helical support formed as an integral component of the nose projecting axially and forwardly from the tubular body of the quill.

In accordance with other aspects of the present invention, the guide trough segments are subdivided into a continuous bottom comprising the outer rim of the helical support, with the side walls being segmented, detachably secured to the trough bottom, and readily replaceable when worn.

These and other objects, features and advantages of the present invention will become more apparent upon reading the following detailed description in conjunction with the accompanying drawings.

DETAILED DESCRIPTION

Figure 1:
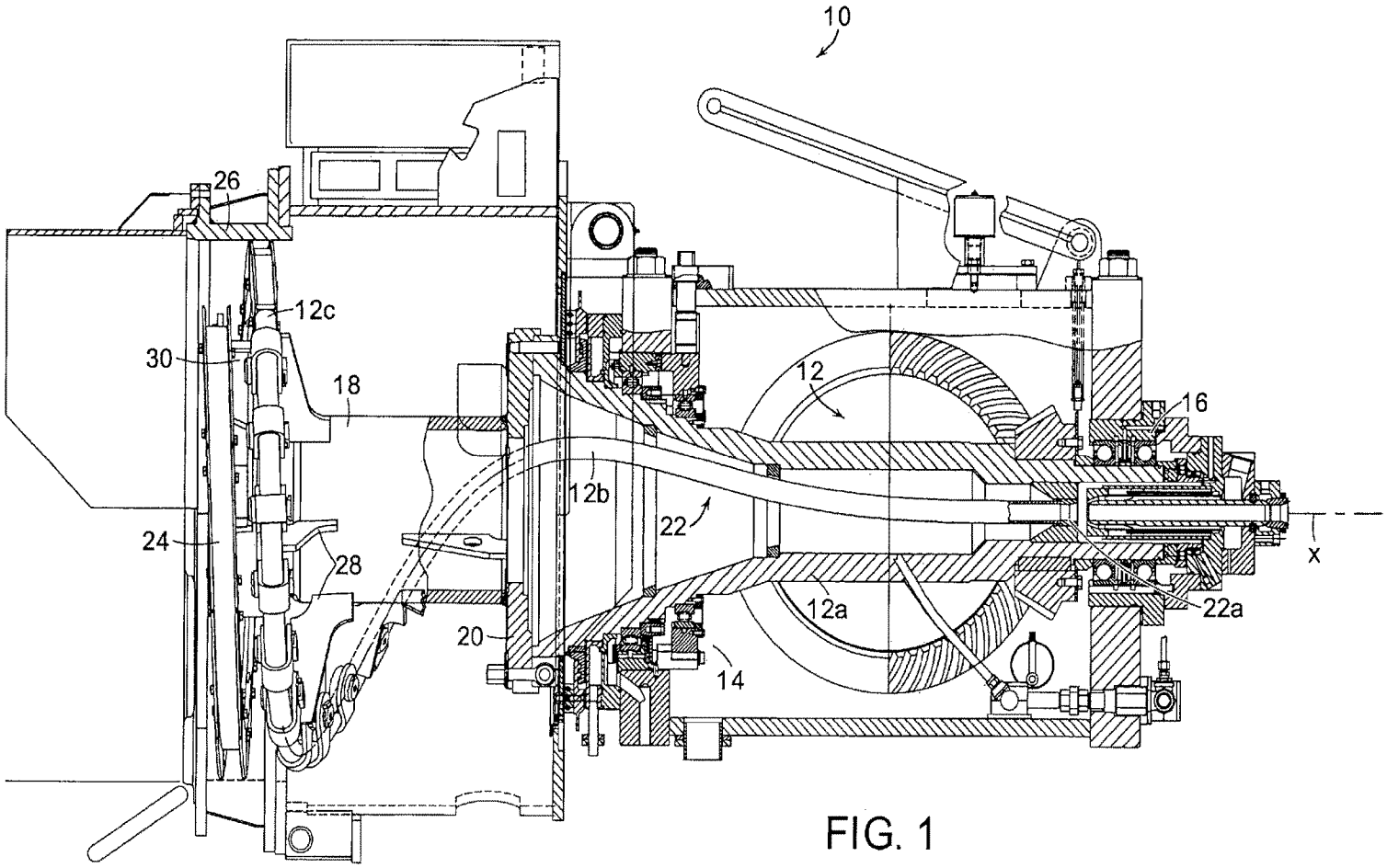
FIG. 1 PRIOR ART
FIG. 1 is a side view, with portions in section, of a conventional laying head.
Figure 2:
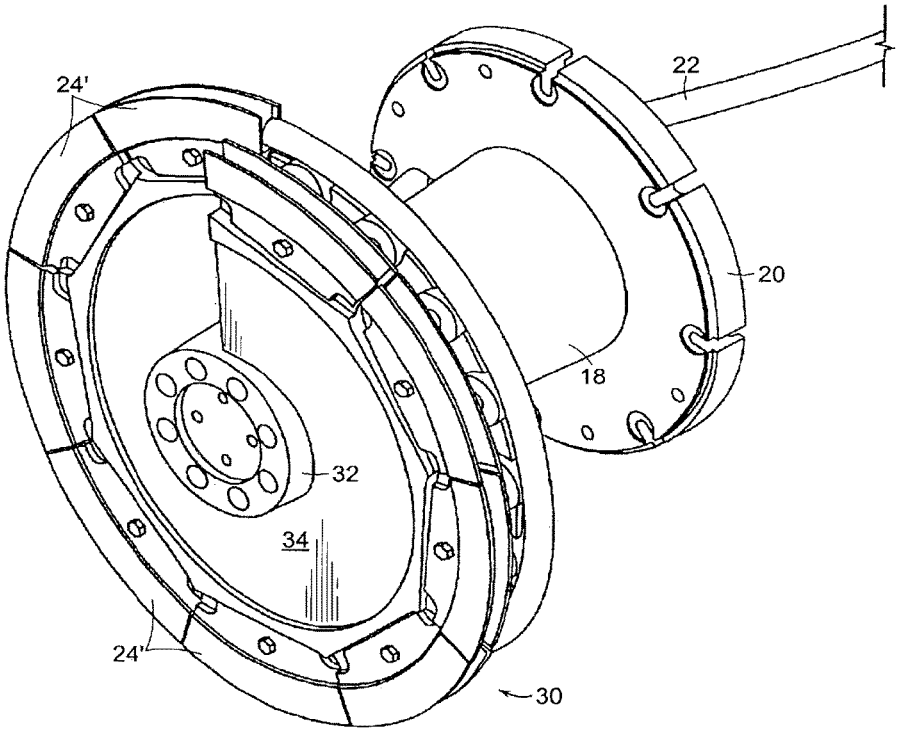
FIG. 2 PRIOR ART
FIG. 2 is a perspective front view of the nose and guide trough assembly of the conventional laying head shown in FIG. 1.
Figure 3:
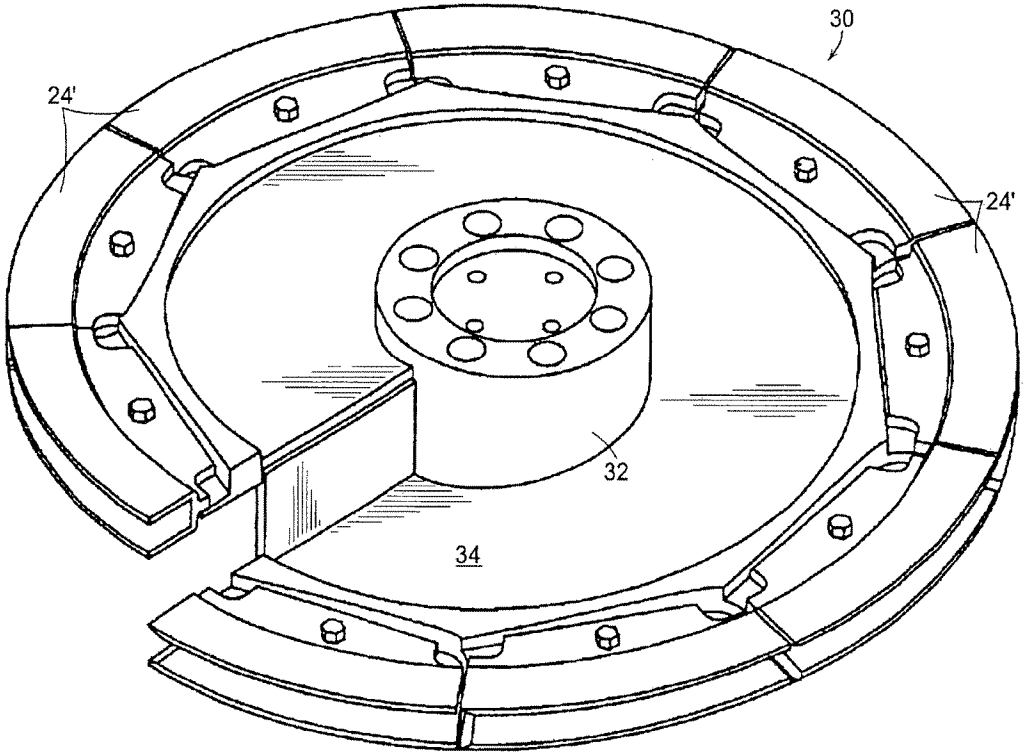
FIG. 3 PRIOR ART
FIG. 3 is a partially exploded perspective view of the conventional guide trough assembly shown in FIGS. 1 and 2.
Figure 4:
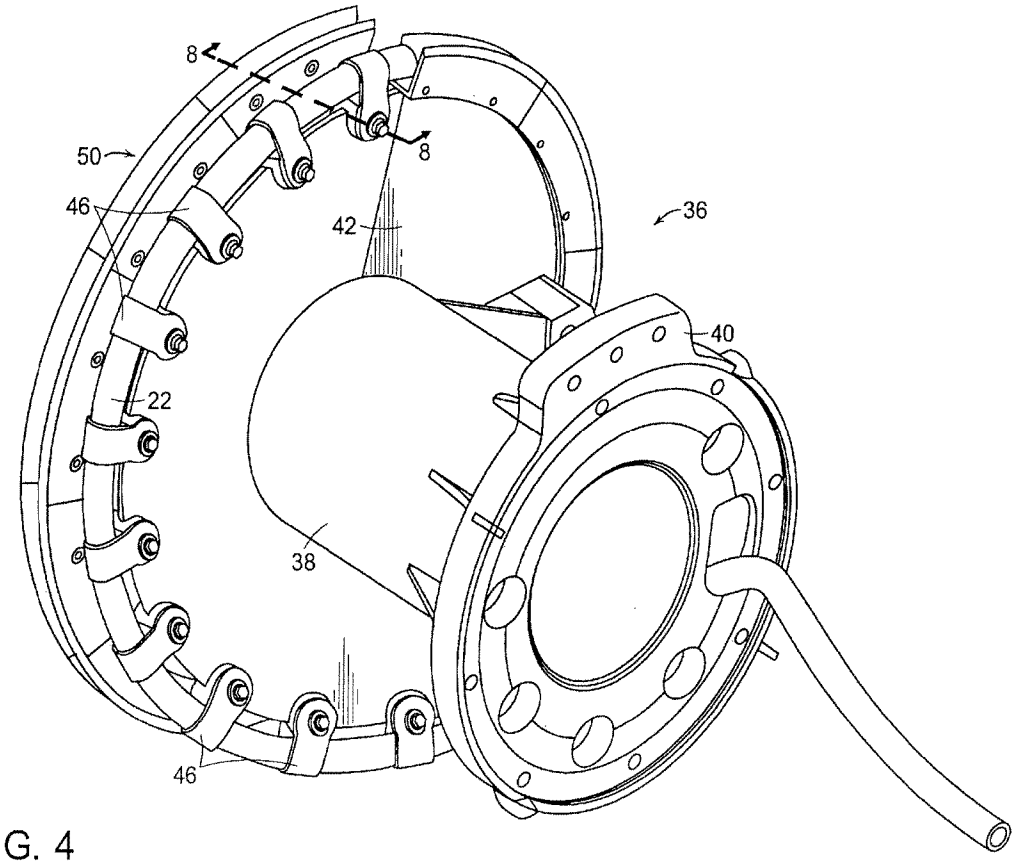
FIG. 4 is a rear perspective view of the nose of a laying head quill in accordance with an exemplary embodiment of the present invention, with the laying pipe and guide trough carried on a continuous helical support comprising an integral component of the nose.

In accordance with the present invention, the conventional assembly of the nose 18 and separate disc-shaped trough support 30 depicted in FIG. 1 is replaced by a unitary nose 36, an exemplary embodiment of which is depicted in FIG. 4. The unitary nose 36 has a central tubular body 38 provided at one end with a mounting flange 40 adapted to be connected to the tubular body 12*a* of the conventional laying head quill 12 shown in FIGS. 1-3. A helical support, which may comprise a continuous auger plate 42 configured as an unwinding spiral scroll, is permanently joined to the central body 38.

Figure 5:
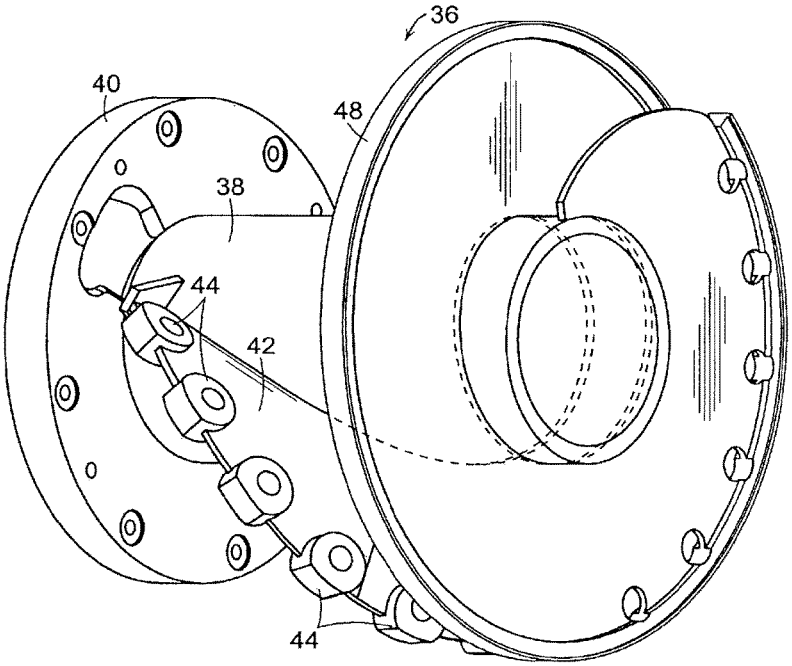
FIG. 5 is a front perspective of the nose depicted in FIG. 4.
Figure 6:
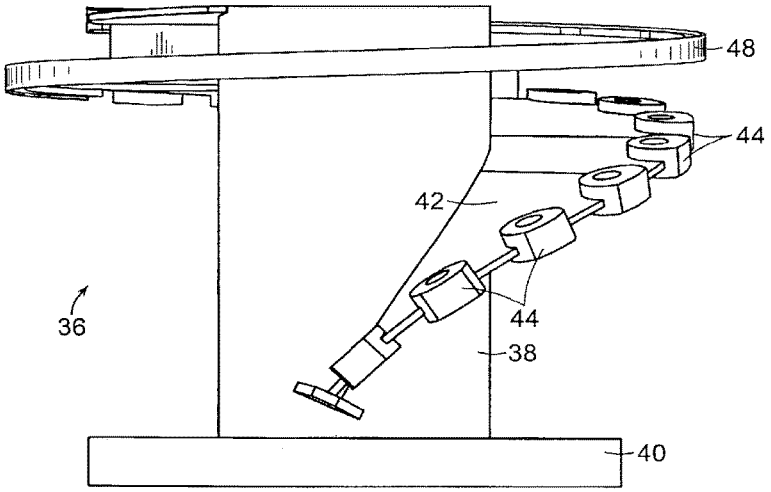
FIG. 6 is a view showing one side of the nose depicted in FIG. 5.
Figure 7:
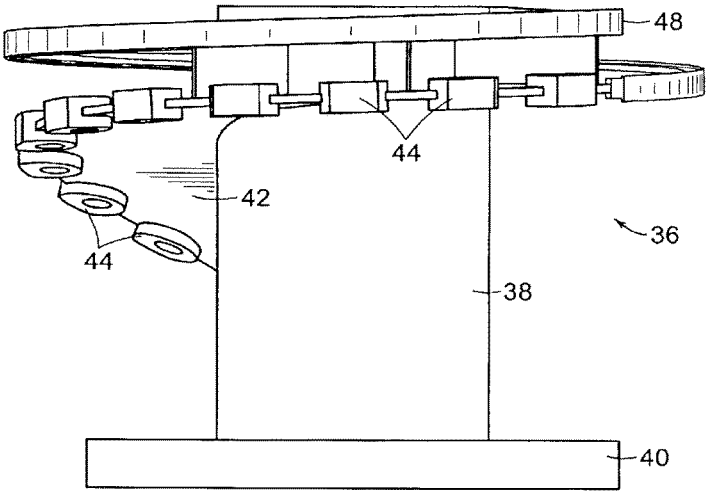
FIG. 7 is a view showing the opposite side of the nose depicted in FIG. 5.

As can best be seen by additional reference to FIGS. 5-7, the auger plate 42 extends continuously from the mounting flange 40 to the distal end of the central body 38. A segment of the plate 42 carries brackets 44 on its rim. As can best be seen in FIG. 4, the brackets 44 coact with clamps 46 to secure the laying pipe 22 in its operative position. The remaining rim of the auger plate 42 is defined by a continuous collar serving as the bottom 48 of a channel-shaped guide trough 50.

By supporting both the laying pipe 22 and the guide trough 50 on a continuous auger plate 52 formed as an integral component of the cantilevered nose 36, stress concentrations are significantly reduced. This in turn makes it possible to reduce the weight of the nose 36, with the result that the center of gravity of the laying head's rotating assembly is advantageously shifted rearwardly and closer to the bearings 14, 16. Overall rigidity and resistance to vibration is thus beneficially enhanced.

Figure 8:
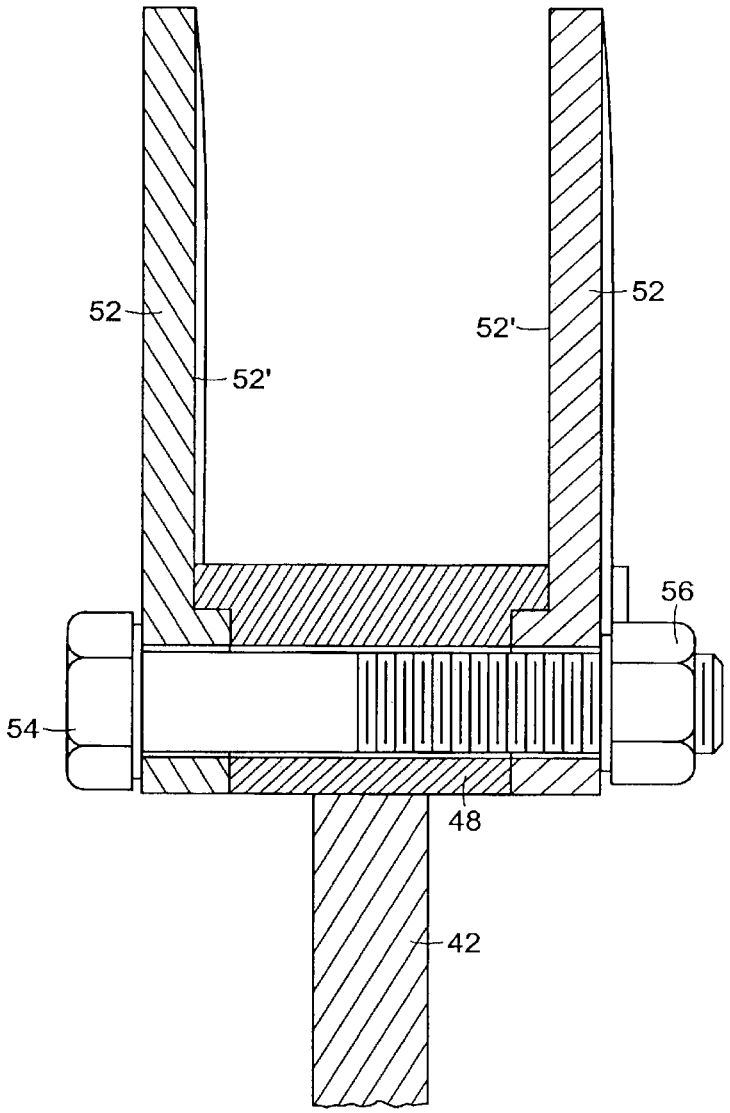
FIG. 8 is a sectional view on an enlarged scale taken along line 8-8 of FIG. 4 and showing details of trough segments in accordance with an exemplary embodiment of the present invention.
Figure 9A:
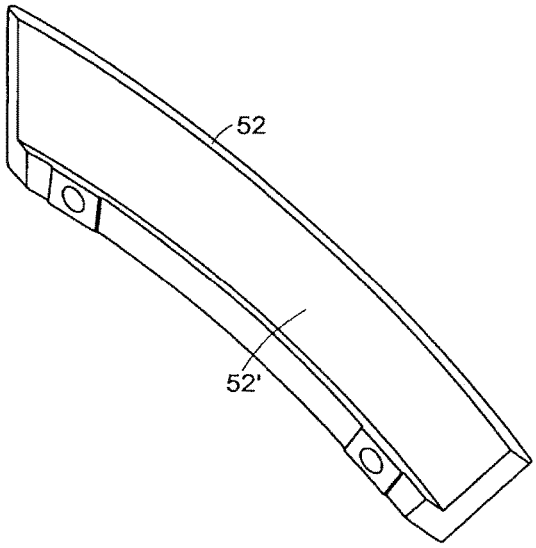
FIGS. 9A and 9B are respectively perspective and side views of a guide trough side wall segment in accordance with an exemplary embodiment of the present invention.
Figure 9B:
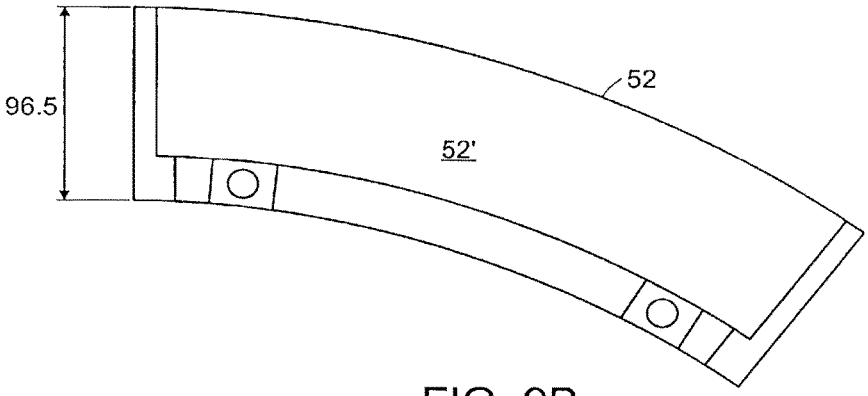

With reference to FIGS. 8, 9A and 9B, the sides 52 of the guide trough 50 are segmented and detachable secured to the bottom 48 by conventional fasteners which may comprise bolts 54 and nuts 56. An exemplary embodiment of a trough side wall segment 52 is depicted in FIGS. 9A and 9B.

When individual side wall segments 52 experience accelerated wear, they may be readily replaced without replacing others that experience lesser wear.

Preferably, the side wall segments 52 are identical. The side wall segments may be cast or fabricated from light weight wear resistant materials, illustrative examples including aluminum, aluminum alloys, carbon fibers, thermoplastics, etc. Additionally, or alternatively, the interior surfaces 52' of the side wall segments 52 may comprise or be coated with a wear resistant material, for example, a nano metal.

The foregoing description and drawings are merely illustrative of the principles of the present invention and are not to be construed in a limiting sense. Various changes are modifications will become apparent to those of ordinary skill in the art. All such changes and modifications are seen to fall within the scope of the invention as defined by the appended claims.

What is claimed is:

1. A laying head for forming an axially moving hot rolled product into a helical series of rings, said laying head comprising:

a quill rotatable about an axis, said quill having a tubular body journaled for rotation between axially spaced bearings, and having a nose projecting axially and forwardly from said body, said nose comprises a unitary structure having a central tubular body provided at one end with a mounting flange adapted to be connected to said central tubular body;

a product guide carried by said quill, said product guide having an entry end aligned with said axis and arranged to receive said product, and having an intermediate curved portion leading from said entry end to a delivery end spaced radially from said axis and from which said product is discharged as said helical series of rings;

a guide trough providing a helical extension of said product guide, the intermediate curved portion and delivery end of said product guide and said guide trough being carried on a continuous helical support on the nose of said quill, wherein a portion of said helical support is defined by a continuous collar serving as a bottom of said guide trough, said helical support formed as an integral component of said nose.

2. The laying head of claim 1 wherein said helical support comprises an auger plate configured as a spiral scroll projecting radially from said nose.

3. The laying head of claim 1 wherein said nose is detachably secured to said tubular body.

4. The laying head of claim 1 wherein said helical support is a fabricated component integrally joined to said nose.

5. The laying head of claim 1 wherein said product guide comprises a pipe.

6. The laying head of claim 5 wherein said pipe is detachably secured to said helical support.

7. The laying head of claim 1 wherein said bottom of said guide trough is defined by an outer rim of said helical support,with detachable side walls projecting radially outwardly from said bottom.

8. The laying head of claim 7 wherein said detachable side walls are subdivided into segments.

9. The laying head of claim 8 wherein said side wall segments are substantially identical.

10. The laying head of claim 8 wherein said side wall segments are fabricated from aluminum or aluminum alloys.

11. The laying head of claim 8 wherein said side wall segments are fabricated from carbon fiber.

12. The laying head of claim 8 wherein said side wall segments are fabricated from thermoplastics.

13. The laying head of claim 8 wherein said side wall segments are coated with a wear resistant material.

14. The laying head of claim 13 wherein said wear resistant material comprises a nano metal.

15. A laying head for forming an axially moving hot rolled product into a helical series of rings, said laying head comprising:

a quill rotatable about an axis, said quill having a tubular body journaled for rotation between axially spaced bearings, and having a nose projecting axially and forwardly from said body, said nose comprises a unitary structure having a central tubular body provided at one end with a mounting flange adapted to be connected to the tubular body;

a product guide carried by said quill, said product guide having an entry end aligned with said axis and arranged to receive said product, and having an intermediate curved portion leading from said entry end to a delivery end spaced radially from said axis and from which said product is discharged as said helical series of rings; and a channel shaped guide trough providing a helical extension of said product guide, said guide trough having a continuous bottom and segmented detachable side walls, wherein said continuous bottom is defined by a continuous collar, said nose comprises said helical extension formed as an integral component of said nose.

16. The laying head of claim 15 wherein the intermediate curved portion and delivery end of said product guide and said guide trough are carried on a continuous helical support fabricated as an integral component of said nose.

17. The laying head of claim 16 wherein the bottom of said guide trough comprises an outer rim of said helical support.

18. The laying head of claim 16 wherein said product guide comprises a pipe detachably secured to an outer rim of said helical support.

19. The laying head of claim 15 wherein said nose is detachably secured to said tubular body.

20. A tubular nose adapted to project axially in cantilever fashion comprising: a rotatable quill of a rolling mill laying head, said quill carrying a product guide having an entry end aligned with a rotational axis of the quill, and an intermediate curved portion leading from said entry end to a delivery end communicating with a guide trough providing a helical extension of said product guide, said nose having an auger plate configured and arranged to provide continuous support for said guide trough and for the intermediate curved portion and delivery end of said product guide, wherein a portion of a rim of the auger plate is defined by a continuous collar serving as a bottom of said guide trough, said auger plate is fabricated as an integral component of said nose.

21. The nose of claim 20 wherein the rim of said auger plate is an outer rim of and comprises the bottom of said guide trough.

22. The nose of claim 20 having one end thereof configured and arranged to be detachably secured to said quill.

23. The nose of claim 20 wherein the intermediate curved portion and delivery end of said product guide are secured by brackets on the rim of said auger plate.

* * * * *